US008878867B2

(12) United States Patent
Sundbom

(10) Patent No.: US 8,878,867 B2
(45) Date of Patent: Nov. 4, 2014

(54) TRANSPARENCY INFORMATION IN IMAGE OR VIDEO FORMAT NOT NATIVELY SUPPORTING TRANSPARENCY

(75) Inventor: Oskar Härje Johan Valdemar Sundbom, Stockholm (SE)

(73) Assignee: Blackberry Limited, Waterloo (CA)

( * ) Notice: Subject to any disclaimer, the term of this patent is extended or adjusted under 35 U.S.C. 154(b) by 331 days.

(21) Appl. No.: 13/493,678

(22) Filed: Jun. 11, 2012

(65) Prior Publication Data

US 2013/0328908 A1 Dec. 12, 2013

(51) Int. Cl.
*G09G 5/02* (2006.01)

(52) U.S. Cl.
USPC ..... 345/592

(58) Field of Classification Search
None
See application file for complete search history.

(56) References Cited

U.S. PATENT DOCUMENTS

| | | | | |
|---|---|---|---|---|
| 6,400,832 | B1 * | 6/2002 | Sevigny | 382/103 |
| 2001/0040584 | A1 * | 11/2001 | Deleeuw | 345/629 |
| 2004/0160456 | A1 | 8/2004 | Steele et al. | |
| 2005/0110803 | A1 * | 5/2005 | Sugimura | 345/629 |
| 2006/0256380 | A1 * | 11/2006 | Klassen et al. | 358/1.16 |
| 2010/0066762 | A1 * | 3/2010 | Yeh et al. | 345/629 |
| 2010/0220105 | A1 | 9/2010 | Roh et al. | |
| 2011/0126160 | A1 | 5/2011 | Han et al. | |
| 2011/0216086 | A1 * | 9/2011 | Hitosugi | 345/629 |
| 2012/0121175 | A1 * | 5/2012 | Narayanan et al. | 382/166 |

FOREIGN PATENT DOCUMENTS

EP 1521458 A1 4/2005

OTHER PUBLICATIONS

Exporting video with transparency; http://forums.creativecow.net/thread/2/921645#921652; Nov. 20, 2007; retrieved on Apr. 26, 2012.
Saving images with transparency; http://docs.gimp.org/en/gimp-using-web-transparency.html; retrieved on Apr. 26, 2012.
Poter, Thomas; Compositing Digital Images vol. 18, No. 3. http://keithp.com/~keithp/porterduff/p253-porter.pdf; Jul. 1984.
The mtPaint handbook—Chapter 7—Channels; http://mtpaint.sourceforge.net/handbook/en_GB/chap_07.html; retrieved on Apr. 26, 2012.
[Spice-devel] [Patch] Lossy compression of RGBA images (on WAN connection); http://lists.freedesktop.org/archives/spice-devel/2010-June/000548.html; Jun. 20, 2010; retrieved on Apr. 26, 2012.
Extended European search report mailed Feb. 18, 2013, in corresponding European patent application No. 12171553.6.
Anonymous; "2D+Z"—Dimenco; Jul. 20, 2011, XP002689587, retrieved from the internet: URL: http://web.archive.org/web/20110720160048/http://www.dimenco.eu/2dz/; retrieved on Dec. 18, 2012.

* cited by examiner

*Primary Examiner* — Phi Hoang
*Assistant Examiner* — Mohammad H Akhavannik
(74) *Attorney, Agent, or Firm* — Novak Druce Connolly Bove + Quigg LLP

(57) ABSTRACT

Colour information and transparency information of pixels of a source image, which may be a partially transparent overlay image of a format that natively support transparency, are stored as a transformed image. The transformed image is of a format that does not natively support transparency. The transformed image has two disjoint regions, one storing the source color information and the other storing the source transparency information. The transformed image can be used as a representation of the overlay image when compositing with a base image.

27 Claims, 9 Drawing Sheets

TRANSPARENCY INFORMATION IN IMAGE OR VIDEO FORMAT NOT NATIVELY SUPPORTING TRANSPARENCY

FIELD

This disclosure relates generally to electronic images and video, and specifically to transparency information in electronic images and video.

BACKGROUND

Using transparency in images and video typically requires specialized hardware or software as well as abundant processing and memory resources. Image and video formats that support transparency, e.g., RGBA, are not widely supported and are generally not portable and may rely on specialist hardware or encoder/decoder implementations.

BRIEF DESCRIPTIONS OF THE DRAWINGS

For a better understanding of the various implementations described herein and to show more clearly how they may be carried into effect, reference will now be made, by way of example only, to the accompanying drawings in which.

DETAILED DESCRIPTION

Figure 1:
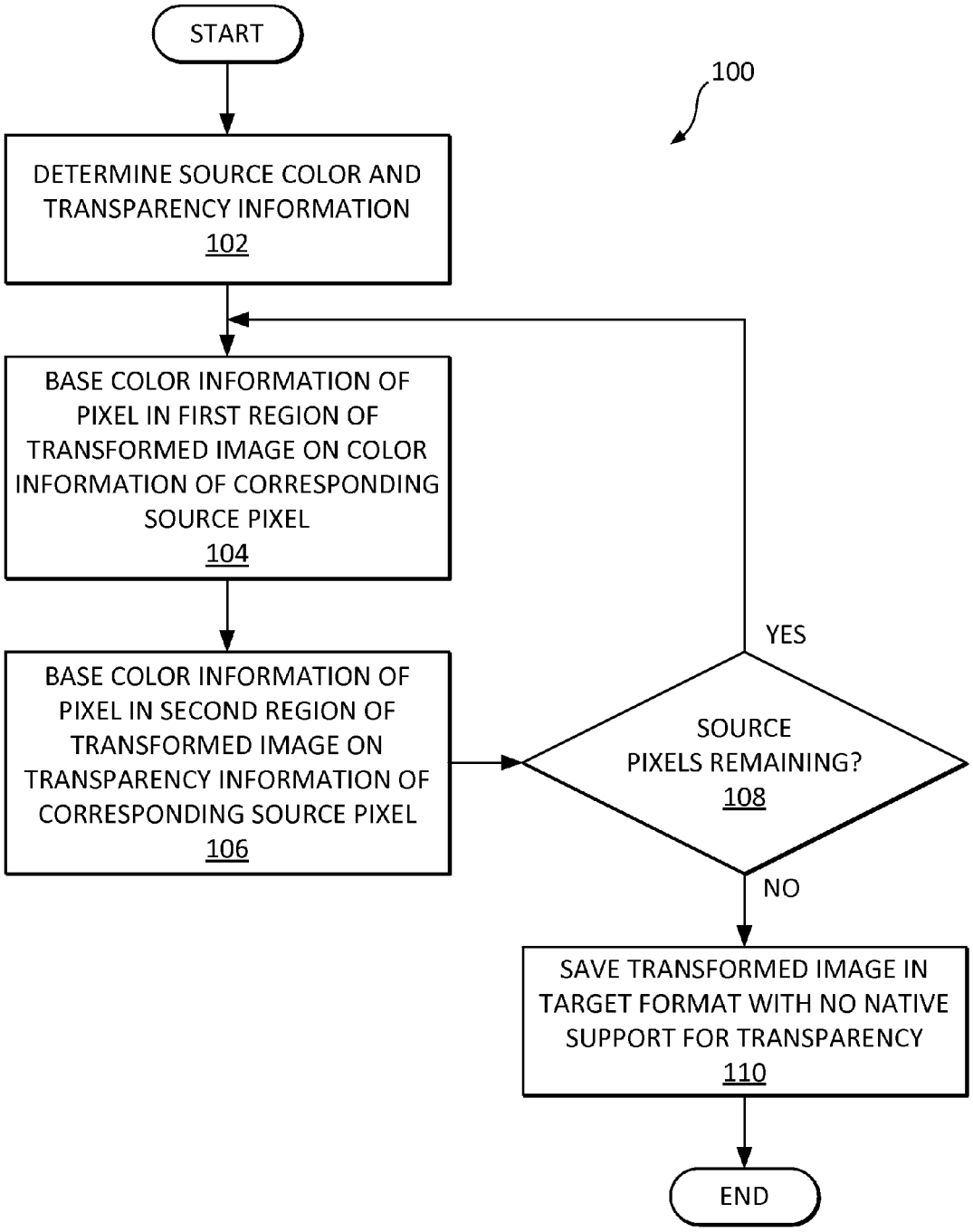
FIG. 1 is a flowchart of a method of generating a transformed image from a source image.

The techniques described in this disclosure can allow for efficient use of transparency information in image and video formats that do not natively support transparency. Transparency information can thus be used in widely supported perceptual codecs, such as H.264 and JPEG. File sizes of images/videos having partial transparency can be reduced, which is advantageous when distributing such files over a network. Furthermore, the use of widely supported perceptual codecs allows for known lossy compression techniques to be used.

An aspect of the specification provides a method of transforming source image data for a source image, the source image data being in a source format providing native support for transparency, the method comprising: determining, from the source image data, colour information and transparency information for each source pixel of the source image; generating a transformed image including a first region and a second region by: for each source pixel of the source image, basing colour information of a corresponding pixel of the first region on the colour information of that source pixel; and basing colour information of a corresponding pixel of the second region on the transparency information of that source pixel; and saving the transformed image in a target format not providing native support for transparency.

The source format can be a compressed format, and wherein determining can comprise decompressing the source image.

The source format can be a vector-graphic format, and wherein determining can comprise: setting dimensions of the source image; and computing colour information and transparency information for each source pixel of the source image based on the dimensions of the source image.

The target format can be a compressed format, and wherein saving can comprise compressing the transformed image. Compressing can comprise applying a transform to colour information for blocks of pixels to obtain frequency-domain information.

The colour information of each pixel of the first region can equal the colour information of the source pixel corresponding to that pixel of the first region.

The colour information of each pixel of the second region can comprise three equal colour components.

The first region can be disjoint from the second region. The first region and the second region can be adjacent regions, each having the same dimensions as the source image.

Basing the colour information of the corresponding pixel of the second region on the transparency information of the source pixel further can comprise performing a geometric transformation such that at least one dimension of the second region is less than a corresponding dimension of the first region.

The transformed image can comprise at least part of a corresponding frame of a transformed video.

A first frame of the transformed video can comprise the first region and a second frame of the transformed video can comprise the second region.

Another aspect of the specification provides a method of superimposing a partially transparent overlay image on a base image, an overlay representation of the overlay image being in a format not providing native support for transparency, the overlay representation including a first region of pixels—whose colour information represents colour information of corresponding pixels of the overlay image—and a second region of pixels—whose colour information represents transparency information of corresponding pixels of the overlay image, the method comprising: for each base pixel in the base image: determining first colour information from the colour information of that base pixel; determining second colour information from the colour information of at least one corresponding pixel of the first region of the overlay representation; determining transparency information from the colour information of at least one corresponding pixel of the second region of the overlay representation; and computing colour information for a corresponding pixel of a composited image by combining the first colour information, the second colour information, and the transparency information; and saving the composited image in a format not providing native support for transparency.

Computing colour information can comprise computing a weighted average of the first colour information and the second colour information, the weighting being determined by the transparency information.

The method can further comprise determining the locations of the first region and of the second region within the overlay representation.

At least one of the base image and the overlay representation can be in a compressed format, and wherein the method can further comprise decompressing the at least one of the base image and the overlay representation.

The format of the compo sited image can be a compressed format, and wherein saving can comprise compressing the composited image. Compressing can comprise applying a transform to colour information for blocks of pixels to obtain frequency-domain information.

Determining the transparency information can comprise using a predetermined colour component of the colour information of the corresponding pixel of the second region of the overlay representation.

Determining the transparency information can comprise averaging colour components of the colour information of the corresponding pixel of the second region of the overlay representation.

At least one dimension of the overlay image can be different than the corresponding dimension of the base image, and wherein determining the second colour information and determining the transparency information can each comprise a scaling operation based on the dimensions of the overlay image and of the base image.

The base image can comprise at least part of a frame of a base video, and wherein the composited image can comprise at least part of a corresponding frame of a composited video.

The overlay representation can comprise at least part of a frame of an overlay representation video.

Determining the transparency information can comprise performing a geometric transformation on the second region of the overlay image. The geometric transformation can comprise a scaling operation.

Yet a further aspect of the specification provides an electronic device comprising: memory; and a processor coupled to the memory, the processor configured to: determine, from source image data, colour information and transparency information for each source pixel of a source image, the source image data being in a source format providing native support for transparency; generate a transformed image including a first region and a second region by: for each source pixel of the source image, basing colour information of a corresponding pixel of the first region on the colour information of that source pixel; and basing colour information of a corresponding pixel of the second region on the transparency information of that source pixel; and save the transformed image in a target format not providing native support for transparency.

Yet another aspect of the specification provides an electronic device comprising: memory; and a processor coupled to the memory, the processor configured to: superimpose a partially transparent overlay image on a base image, an overlay representation of the overlay image being in a format not providing native support for transparency, the overlay representation including a first region of pixels—whose colour information represents colour information of corresponding pixels of the overlay image—and a second region of pixels—whose colour information represents transparency information of corresponding pixels of the overlay image, by, for each base pixel in the base image: determining first colour information from the colour information of that base pixel; determining second colour information from the colour information of at least one corresponding pixel of the first region of the overlay representation; determining transparency information from the colour information of at least one corresponding pixel of the second region of the overlay representation; and computing colour information for a corresponding pixel of a composited image by combining the first colour information, the second colour information, and the transparency information; and save the composited image in a format not providing native support for transparency.

Yet a further aspect of the specification provides a non-transitory computer-readable medium storing processor-executable instructions that when executed cause a processor to: determine, from source image data, colour information and transparency information for each source pixel of a source image, the source image data being in a source format providing native support for transparency; generate a transformed image including a first region and a second region by: for each source pixel of the source image, basing colour information of a corresponding pixel of the first region on the colour information of that source pixel; and basing colour information of a corresponding pixel of the second region on the transparency information of that source pixel; and save the transformed image in a target format not providing native support for transparency.

Yet another aspect of the specification provides a non-transitory computer-readable medium storing processor-executable instructions that when executed cause a processor to: superimpose a partially transparent overlay image on a base image, an overlay representation of the overlay image being in a format not providing native support for transparency, the overlay representation including a first region of pixels—whose colour information represents colour information of corresponding pixels of the overlay image—and a second region of pixels—whose colour information represents transparency information of corresponding pixels of the overlay image, by, for each base pixel in the base image: determining first colour information from the colour information of that base pixel; determining second colour information from the colour information of at least one corresponding pixel of the first region of the overlay representation; determining transparency information from the colour information of at least one corresponding pixel of the second region of the overlay representation; and computing colour information for a corresponding pixel of a composited image by combining the first colour information, the second colour information, and the transparency information; and save the composited image in a format not providing native support for transparency.

Yet a further aspect of the specification provides a non-transitory computer-readable medium storing a digital representation of a partially transparent image in an image format not providing support for transparency, the representation comprising: a first region of pixels, whose colour information represents the colour information of corresponding pixels of the partially transparent image; and a second region of pixels, whose colour information represents the transparency information of corresponding pixels of the partially transparent image.

The dimensions of the first region and of the second region can equal the corresponding dimensions of the overlay image.

The first region can be disjoint from the second region.

The representation can be of at least a portion of a frame of a video.

A geometric transformation can be performed on the first region of the overlay representation when determining the second color information.

A geometric transformation can be performed on the second region of the overlay representation when determining the transparency information.

Referring to FIG. 1, a method 100 of transforming source image data for a source image is illustrated. Source image data suitable for use with the method 100 includes still image data or video data that is in a source format providing native support for transparency, such as RGBA. The term image data generally refers to data representing a portion of or an entire still image or data representing a portion of or an entire frame of video made up of a sequence of frames. Image data in the source format is processed by the method 100 to obtain a transformed image in a target format that does not provide native support for transparency. However, as will be discussed, the transformed image retains the source image's transparency information. The method 100 may be used in various scenarios, such as when creating or preparing a video using a program or device supporting a transparency-aware format for use by a program or device that does not support such transparency-aware format. In other scenarios, the program or device that uses the image or video may support a transparency-aware format, but it may be desirable to save processor, storage, or other resources but avoiding the use of the transparency-aware format.

At step 102, colour information and transparency information for the source image are determined. This may include capturing, saving, or creating an image or video that may represent an image or video overlay effect, such as a crosscut effect or a grainy film effect, to be applied to a base image or video.

The source image data conforms to the source format, which provides native support for transparency. An example of such a format is RGBA, in which each pixel is represented by a value quartet having components, which can range in value from 0 to 255 (e.g., RGBA8888). The pixel value quartets are representative of red (R), green (G), blue (B), and alpha (A) channels. The RGB color channels store color information. The alpha channel represents opacity with, for example, a value of 0 being fully transparent and a value of 255 being fully opaque (i.e., fully non-transparent). Other value ranges include 0 to 15 (e.g., RGBA4444). In addition, the value range of the transparency component need not be the same as the value ranges of the color components, e.g., RGBA5551, which uses five bits for each color component, with value ranges of 0 to 31, and one bit for transparency, with a value range of 0 to 1. The terms opacity and transparency are complementary and will both be used in this disclosure. It is yet further appreciated that the terms transparent, semi-transparent, partially transparent can be interchangeable, generally indicating an image that is at least partially transparent but not opaque. For example, when a range of 0-255 is used to represent full transparency at 0 and fully opaque at 255, images with at least some pixels that are in the 0-254 range can be considered transparent, semi-transparent and/or partially transparent; however transparency/semi-transparency/partial transparency does not preclude some of the pixels having values of 255 (i.e. fully opaque).

In some embodiments, the source format is a compressed format, such as JPEG or H.264. Accordingly, step 102 can also include decompressing the source image from the compressed format.

In some embodiments, the source format is a vector-graphic format, such as SGV or CGM. Accordingly, step 102 can also include setting dimensions of the source image and computing colour information and transparency information for each source pixel of the source image based on the dimensions of the source image. Other techniques for rasterizing a vector image can additionally or alternatively be used.

After the source image is obtained, a transformed image is generated. The transformed image includes a first region and a second region. The first region and the second region can be adjacent regions, each having the same dimensions as the source image. The first region can be disjoint from the second region, meaning that pixels that form part of the first region do not form part of the second region, and vice versa. In this embodiment, the second region is directly below the first region, such that the transformed image is double the height of the source image, while remaining the same width as the source image. In another embodiment, the second region is directly beside the first region, such that the transformed image is double the width of the source image, while remaining the same height as the source image. Irrespective of the particular geometric arrangement of the first region and the second region of the transformed image, each pixel of the source image has a corresponding pixel in each of the first region and the second region.

The transformed image can be generated by processing each pixel of the source image as follows.

At step 104, color information for a given pixel in the first region of the transformed image is based on color information in the correspondingly located pixel of the source image. In this embodiment, the colour information of each pixel of the first region equals the colour information of the source pixel corresponding to that pixel. For example, if the source image is an RGBA formatted image and the transformed image is a double-height RGB image, the pixels in the top half of the transformed image are given the color information of the pixels in the source image. Thus, the top half of the transformed image appears as a fully opaque version of the source image.

At step 106, color information for the given pixel in the second region of the transformed image is based on transparency information in the correspondingly located pixel of the source image. In this embodiment, colour information of each pixel of the second region is made to have three equal colour components. That is, in the example of RGB, the red, green, and blue color components are given the same value. Continuing the above example, the pixels in the bottom half of the transformed image are provided color information that corresponds to the transparency information of the pixels in the source image. Thus, the bottom half of the transformed image appears as a fully opaque representation of the transparency information of the source image, and further, appears as a greyscale representation of transparency when three equal color components are used to store the source transparency information.

Furthermore, step 106 can comprise performing a geometric transformation such that at least one dimension of the second region is less than a corresponding dimension of the first region. In other words, the color information based on the transparency information can be based "squashed" and/or made smaller with respect to the first region, to make the transformed image smaller to save space when storing in a memory and/or bandwidth when transmitting a transformed image.

When no more pixels of the source image remain to be processed in the above manner, at 108, the method 100 continues to step 110 and saves the transformed image in a target format, such as RGB, that does not provide native support for transparency. As mentioned, the transformed image can form at least part of a corresponding frame of a transformed video and the method 100 can be repeated for other frames.

In some embodiments, the target format is a compressed format, such as JPEG or H.264. Accordingly, step 110 can include compressing the transformed image, which can include applying a transform to colour information for blocks of pixels to obtain frequency-domain information. When the transformed image is part of a video, spatial and temporal prediction can be used to reduce file size.

In some embodiments, the color space of the transformed image can also be changed. For example, step 110 can convert the transformed image from the RGB color space to the YCbCr color space.

Although the method 100 is described above as a loop in which substantially all pixels of the source image are iterated through, this is for illustrative purposes and other techniques can be alternatively or additionally used.

Figure 2:
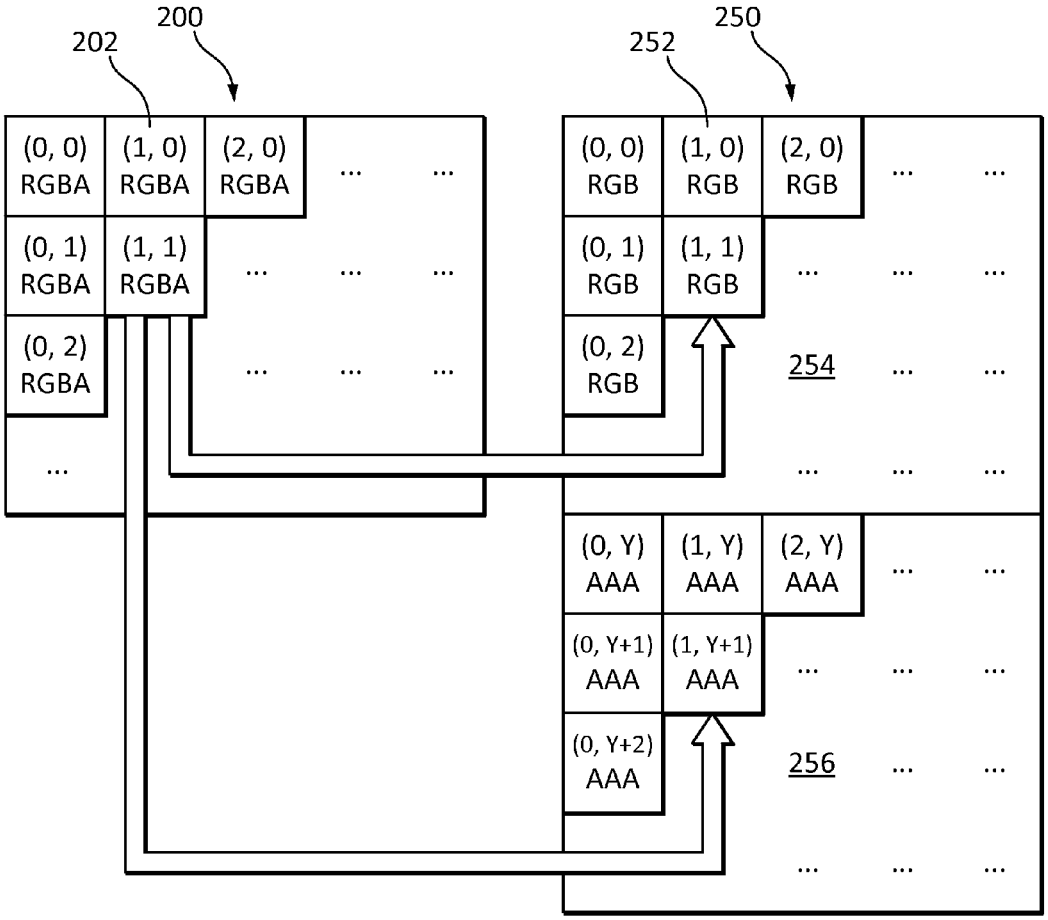
FIG. 2 is a schematic diagram of a source image and a transformed image.

FIG. 2 illustrates a schematic diagram of a source image and a transformed image. FIG. 2 will be discussed in the context of the method 100, however, it should be understood that other methods and devices described herein are also applicable.

The source image 200 includes a plurality of pixels 202 geometrically arranged at coordinates, e.g. (1, 0), of a coordinate system, e.g. (x, y). Each source pixel 202 has color and transparency information stored in a data structure, such as quartets of color and transparency components, which in this example conform to an RGBA format.

The transformed image 250 includes a plurality of pixels 252 geometrically arranged at coordinates of the coordinate system. The transformed image 250 is divided into disjoint first and second regions 254, 256, which share no pixels. In this embodiment, the second region 256 is vertically offset below the first region by an offset Y, which equals the height of the source image 200. That is, if the source image 200 is 640 pixels wide by 360 pixels high, then the transformed image 250 is 640 pixels wide by 720 pixels high. Each transformed pixel 252 has color information stored in a data structure, such as triplets of color components, which in this example conform to an RGB format.

In the first region 254 of the transformed image 250, the color information of the pixels 252 is set to the color information of the pixels 202 of the source image 200. That is, the color information of each source pixel 202 is copied to the transformed pixel 252 at the same coordinates. For example, the transformed pixel 252 at coordinates (1, 1) in the transformed image 250 has the same RGB values as the corresponding source pixel 202 at coordinates (1, 1) in the source image 200, and so on.

In the second region 256 of the transformed image 250, the color information of the pixels 252 stores the transparency information of the pixels 202 of the source image 200. That is, the transparency information of each source pixel 202 is stored at the transformed pixel 252 at the source coordinates modified by the offset Y. In this embodiment, all three color components of each transformed pixel 252 are set to the opacity value, A, of the respective source pixel 202. In other embodiments, fewer than all of the color components of each transformed pixel 252 are set to the opacity value, A, with the other color components being set to a predetermined value, such as zero. Continuing the above example, the transformed pixel 252 at coordinates (1, Y+1) in the transformed image 250 has its three color component values set to the opacity value, A, of the corresponding source pixel 202 at coordinates (1, 1) in the source image 200, and so on.

The transformed image 250 thus stores color and transparency information in a format that does not natively support transparency information.

Figure 3:
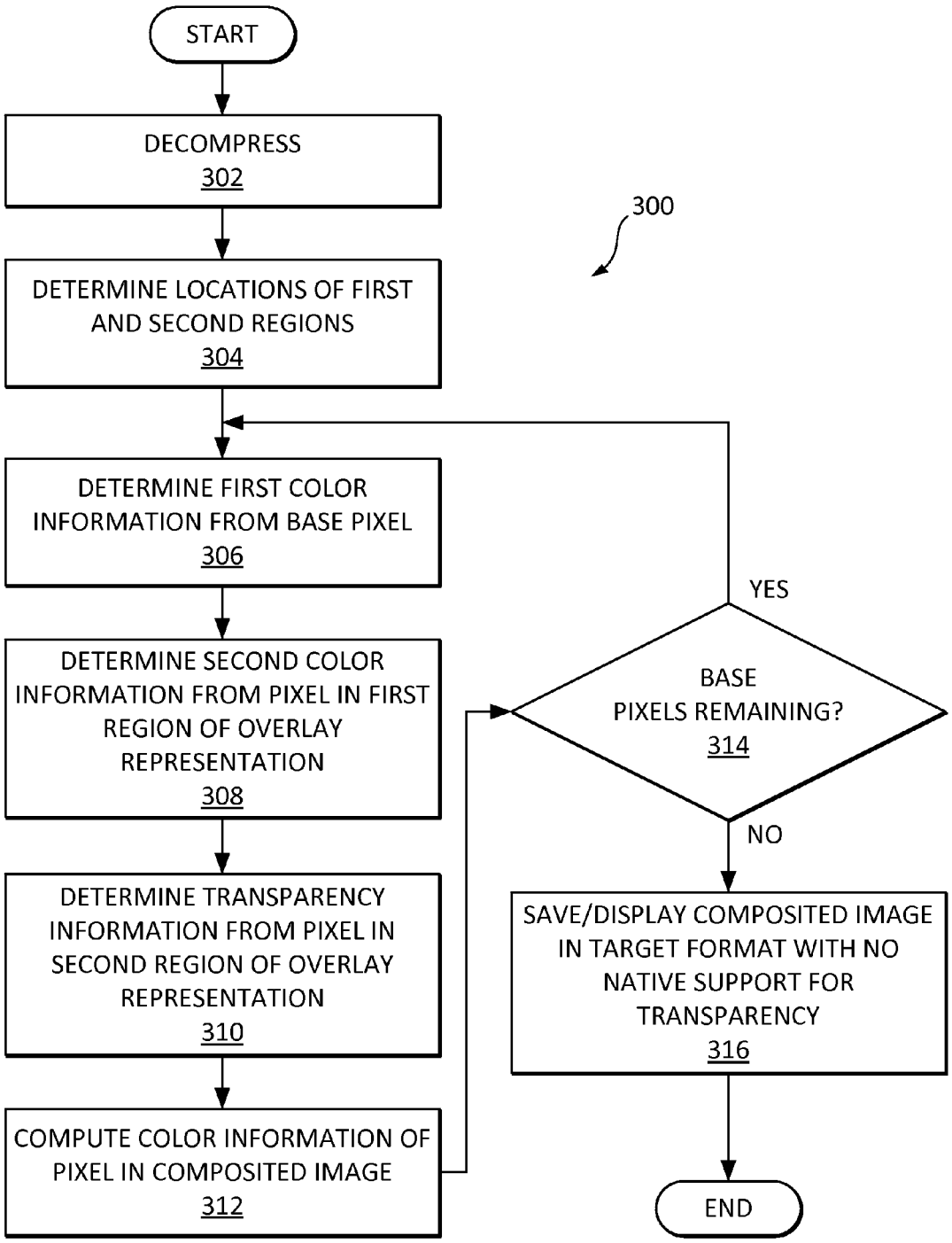
FIG. 3 is a flowchart of a method of generating a composite image from a base image and an overlay representation.

FIG. 3 illustrates a method 300 of superimposing a partially transparent overlay image on a base image to generate a composited image. The base image and an overlay representation of the overlay image are each of a format that does not provide native support for transparency. For example, the base image may be a user-captured picture or at least part of a frame of a user-captured video, and the overlay image may represent an image or video overlay effect, such as a crosscut effect or a grainy film effect. The composited image would thus be a user-captured picture or video being overlaid by a desired visual effect.

The overlay image can be an image such as the source image 200 discussed above, and can be a still image or at least part of a frame of an overlay video. Accordingly, the overlay representation can be a transformed image, such as the transformed image 250 discussed above, which may be generated by the method 100 discussed above. The overlay representation thus includes a first region of pixels, whose colour information represents colour information of corresponding pixels of the overlay image, and a second region of pixels, whose colour information represents transparency information of corresponding pixels of the overlay image.

At step 302, when either or both of the base image and the overlay representation are in a compressed format, such as JPEG or H.264, decompression can be performed.

At step 304, the locations of the first region and of the second region within the overlay representation can be determined. In an example in which the overlay representation is double the height of the base image, it can be determined that the first region begins at the origin and the second region begins at half of the height of the overlay representation. Such determination can be made by analysing the overlay representation for a suitable indication, such as predetermined metadata stored as a file extension, in a header, or in a separate file.

Next, each base pixel in the base image is processed as follows.

At step 306, first colour information is determined from the colour information of the given base pixel. This can be done by directly reading the pixel color components, e.g., the RGB components.

At step 308, second colour information is determined from the colour information of at least one corresponding pixel of the first region of the overlay representation. This can be done by directly reading the pixel color components, e.g., the RGB components.

At step 310, transparency information is determined from the colour information of at least one corresponding pixel of the second region of the overlay representation. This can be done by reading one or more of the pixel color components, e.g., the RGB components, storing the transparency information. In this embodiment, each color component of the triplet of a given pixel stores the same value for the transparency information. Accordingly, a predetermined color component of the pixel triplet, e.g., the R value, can be used as the transparency information. The predetermined color component can be selected to be the color component that is programmatically simplest reference or that is least processor intensive to reference. Moreover, several color components of the pixel triplet can be read and compared as a check to reduce possible errors in determining the transparency. In another embodiment, two or more of the color components of the pixel triplet are averaged (e.g., by taking a mean or median) to determine the transparency information. This may be particularly useful when the overlay representation has been compressed, so that color component values that may have been set to the same value initially take slightly different values due to compression. Furthermore, in embodiments where the second region was geometrically transformed (e.g. "squashed" as described above) a geometric transformation can be performed on the second region of the overlay image. Such a geometric transformation can comprise scaling. In general, the geometric transformation brings the at least one dimension of the second region that was made less than a corresponding dimension of the first region back to the corresponding dimension of the first region.

When the color space of the overlay representation is YCbCr, the first value, i.e., the luminance Y, of the triplet of each pixel can be taken as the transparency information.

Regarding steps 308 and 310, a geometric transformation may be performed on any or both of the first and second regions of the overlay representation to locate the first or second region of the overlay representation with respect to a desired region of the base image. Such a geometric transformation can include any of a scaling operation, an affine transformation, and the like. For example, at least one dimension of the overlay image may be different from the corresponding dimension of the base image. Accordingly, steps 308 and 310 may each include a scaling operation based on the dimensions of the overlay image and of the base image. The scaling operation scales the overlay representation by one or more scaling factors, so that a suitable pixel of the overlay representation referenced in steps 308 and 310 can be selected.

At step 312, colour information for a corresponding pixel of a composited image is determined by combining the first colour information from the base image, the second colour information from the first region of the overlay representation, and the transparency information from the second region of the overlay representation. This can be performed by computing a weighted average of the first colour information and the second colour information using a weighting determined by the transparency information. The obtained opacity value A can be used as the weighting.

When no more pixels of the base image remain to be processed in the above manner, at 314, the method 300 continues to step 316 to save the composited image in a target format, such as RGB, that, in this embodiment, does not provide native support for transparency. In other embodiments, the target format does provide native support for transparency. Additionally or alternatively, the composited image is displayed on a display of an electronic device. When the composited image is only to be displayed, it need not be saved.

In some embodiments, the format of the composited image is a compressed format, such as JPEG or H.264. Accordingly, step 316 can include compressing the composited image, which can include applying a transform to colour information for blocks of pixels to obtain frequency-domain information. When the transformed image is part of a video, compressing can also be performed in the time domain.

Although the method 300 is described above as a loop in which substantially all pixels of the base image are iterated through, this is for illustrative purposes and other techniques can be alternatively or additionally used.

Furthermore, it is appreciated that geometrically transforming the overlay image or representation can be performed to match the overlay image or representation with a desired region of the base image, as described above. Such geometric transformation can occur at any of steps 302 to 312, as desired.

Figure 4:
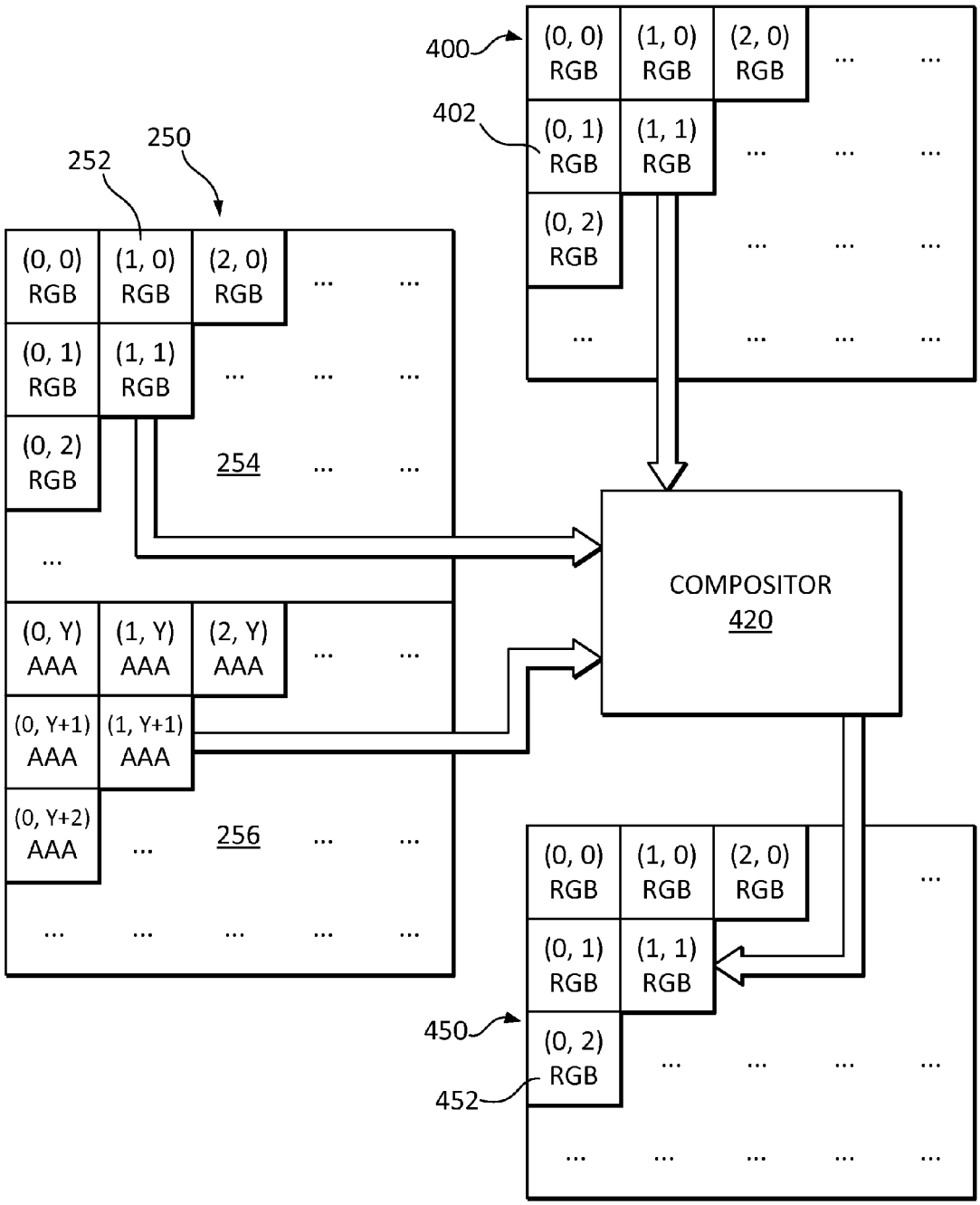
FIG. 4 is a schematic diagram of a base image and an overlay representation being used to generate a composite image.

FIG. 4 illustrates a schematic diagram of compositing a base image and an overlay representation. FIG. 4 will be discussed in the context of the method 300, however, it should be understood that other methods and devices described herein are also applicable.

A transformed image 250, generated as discussed elsewhere herein and including a plurality of pixels 252 in two disjoint regions 254, 256, is provided as the overlay representation of an overlay image (e.g., source image 200 of FIG. 2). The color information of the pixels 252 of the first region 254 store color information and the color information of the pixels 252 of the second region 256 store transparency information as color information, as discussed above. In one example, the overlay representation 250 is downloaded by an electronic device.

A base image 400 including a plurality of pixels 402 is provided. The pixels 402 are geometrically arranged at coordinates, e.g. (1, 0), of a coordinate system, e.g. (x, y). Each base pixel 402 has color information stored in a data structure, such as triplets of color components, which in this example conform to an RGB format. Continuing the example, the base image 400 can be captured or otherwise created by the electronic device.

A compositor 420 can be configured to perform steps of the method 300, and may be configured to perform the entire method 300. In one embodiment, the compositor 420 obtains first color information from pixels 402 of the base image 400, and blends the first color information with second color information obtained from corresponding pixels 252 of the first region 254 of the overlay representation 250 according to opacity information obtained from corresponding pixels 252 of the second region 254 of the overlay representation 250. The result is a composited image 450 made up of a plurality of pixels 452. For example, the compositor 420 obtains color information from the base pixel 402 at coordinates (1, 1), color information from the overlay pixel 252 at coordinates (1, 1), and transparency information from the overlay pixel 252 at coordinates (1, Y+1), and uses such information to compute color information of the composited pixel 452 at coordinates (1, 1). The compositor 420 performs the same for substantially all pixels of the base image 400.

The compositor 420 can operate in real time by generating the composited image as the base image is commanded to be displayed or played. Alternatively, the compositor 420 can save the composited image for later display or playback.

In one embodiment, the compositor 420 uses OpenGL ES. The compositor's above-described operations may be programmed as a shader.

Figure 5:
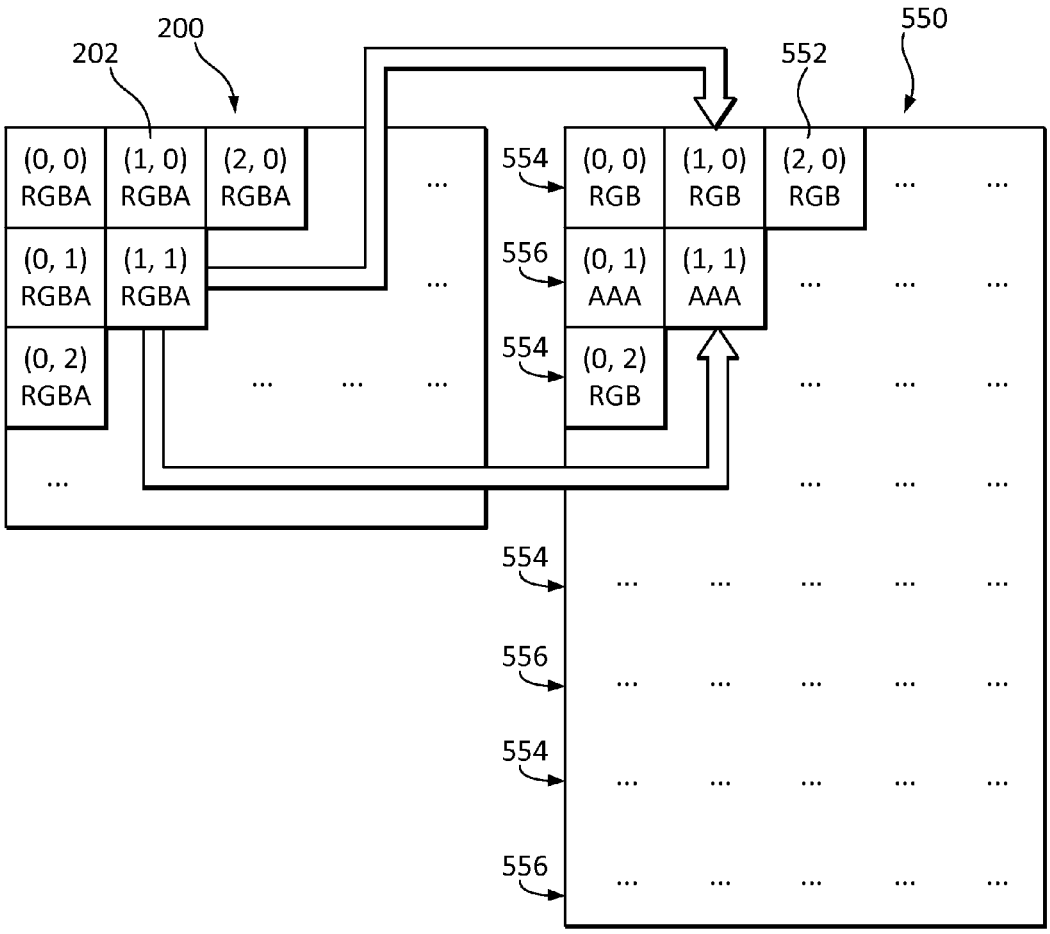
FIG. 5 is schematic diagram of the source image and another transformed image.

FIG. 5 shows another embodiment of a transformed image 550 that can be used as an overlay representation. The transformed image 550 can be generated in a manner similar to that described with regard to the method 100, however, with one difference being that the first and second regions are alternating rows of pixels. Likewise, the transformed image 550 can be referenced as an overlay representation when generating a composite image, with the alternating rows of pixels being referenced accordingly. For other features and aspects of the transformed image 550, the transformed image 250 can be referenced.

As can be seen, the transformed image 550 includes pixels 552 arranged in alternating rows 554, 556 of color information and transparency information of a source image 200. The rows 554 storing color information form a first region and the rows 556 storing transparency information for a second region. The interleaving of the color-bearing rows 554 and the transparency-bearing rows 556 results in the transformed image 550 having double the height of the source image 200.

In another embodiment, pixels storing source transparency information are interleaved between pixels storing source color information.

In still another embodiment, transparency information for three pixels of the source image 200 is stored in the components of the triplet of one pixel of a transformed image. That is, a first source pixel's opacity value is stored in the R component of a transformed pixel, a second source pixel's opacity value is stored in the G component of the transformed pixel, and a third source pixel's opacity value is stored in the B component of the transformed pixel. Accordingly, the transparency information-bearing pixels of the transformed image number one third of the number of pixels in the source image.

Figure 9:
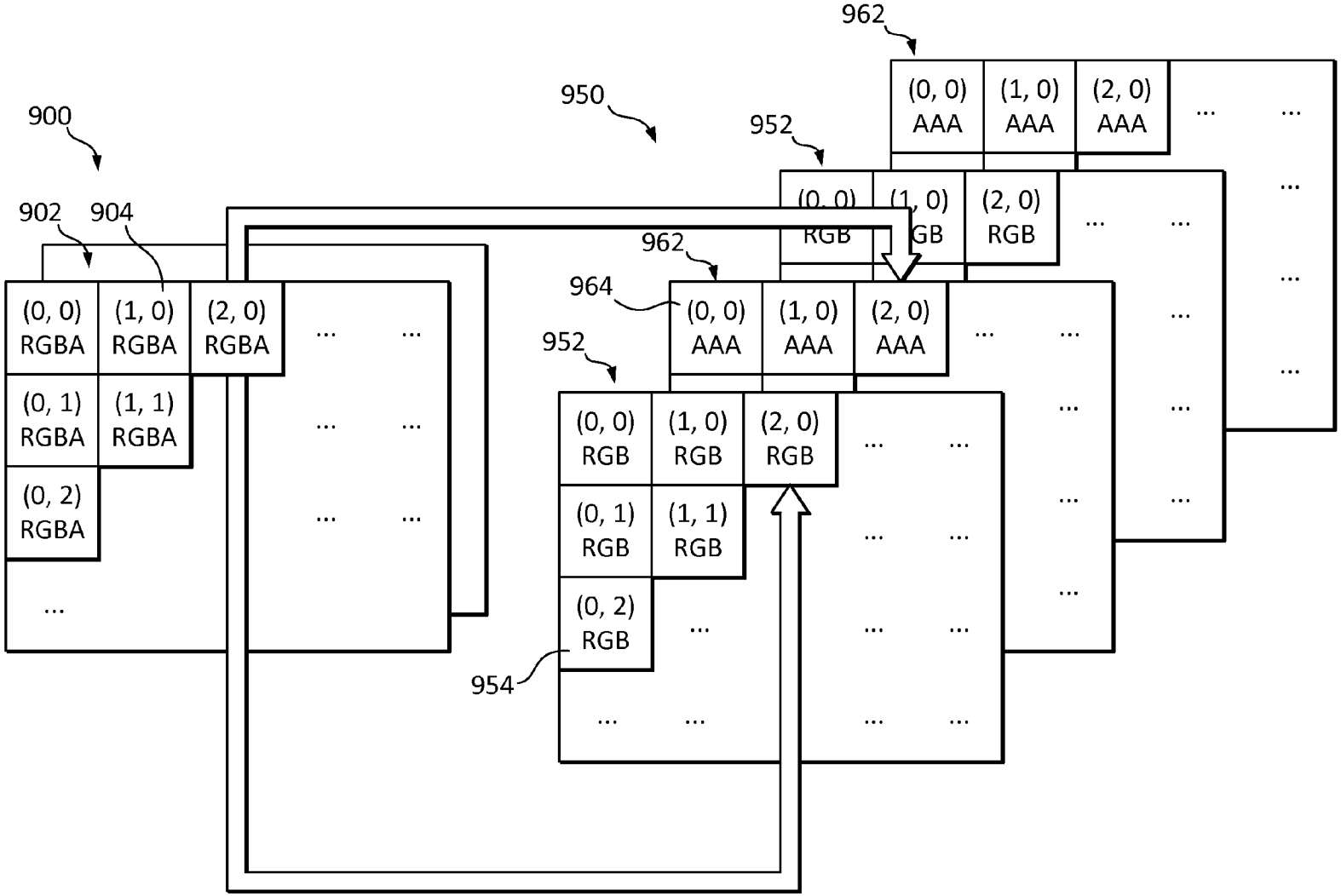
FIG. 9 is a schematic diagram of a source video and a transformed video.

In still another embodiment, pixels storing source transparency information of a video are stored in alternate frames from pixels storing source color information. With reference to FIG. 9, a first frame 952 of a transformed video 950 forms a first region that includes pixels 954 storing color information of pixels 904 of a frame 902 of a source video 900. A second frame 962 of the transformed video 950 forms a second region that includes pixels 964 storing transparency information of the pixels 904 of the frame 902 of the source video 900. The source video 900 is in a format (e.g., RGBA) that natively stores transparency information, while the transformed video 950 is in a format (e.g., H.264) that does not natively store transparency information. The correspondence of pixels based on coordinates as described elsewhere herein can be referenced. The frames of the transformed video 950 alternate between frames 952 of color information and frames of 962 of transparency information, and the transformed video 950 is thus double the frame rate of the source video 900. The transformed video 950 can be used as an overlay representation video for compositing with a base video.

In yet another embodiment, the second region of the transformed image can be scaled so that there are fewer pixels in the second region than in the source image, for example to reduce image size, storage size, bandwidth transmission size and the like, for example by applying a geometric transformation to the source image. Then, when the transformed image is used as an overlay representation, the second region is again scaled to the size of the source image so that the second region has a pixel for each pixel of the base image. Such scaling is performed so that the transformed image (overlay representation) remains rectangular. That is, when the first and second regions are vertically arranged, then second region is vertically scaled. Likewise, when the first and second regions are horizontally arranged, then the second region is horizontally scaled. Scaling the second region can be advantageous when the size of the transformed image is of concern.

Figure 6:
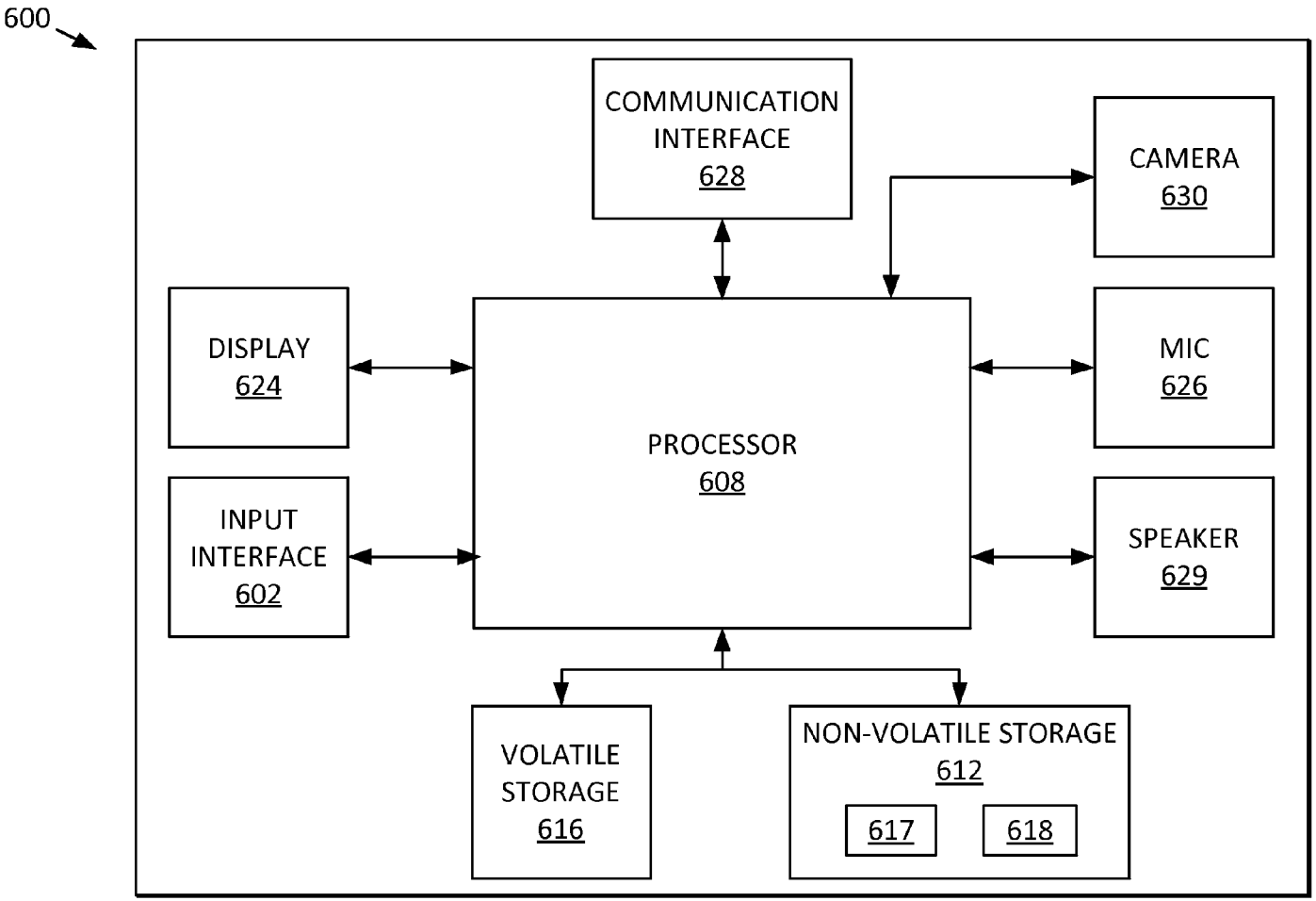
FIG. 6 is a block diagram of an electronic device.

FIG. 6 illustrates an electronic device 600 according to an embodiment. The electronic device can be configured to perform any of the methods described herein and can be configured to generate, store, and communicate any of the source images, transformed images, and overlay images and representations discussed herein.

The electronic device 600 can be a device such as a tablet computer, smart phone, mobile phone, cell phone, personal computer, laptop or notebook computer, netbook, portable or mobile computing device, and the like.

The structure shown in FIG. 6 is purely exemplary, and contemplates a device that can be used for wireless data communications (e.g., email, web browsing, text, and the like) and optionally wireless voice (e.g., telephony).

The device 600 comprises at least one input interface 602 generally enabled to receive human input. The input interface 602 can comprise any suitable one or combination of input devices, including but not limited to a keyboard, a keypad, a pointing device, a mouse, a track wheel, a trackball, a touchpad, a touch screen, and the like. Other suitable input devices are within the scope of the present disclosure.

Input from input interface 602 is received at processor 608 (which can be implemented as a plurality of processors). Processor 608 is configured to communicate with a non-volatile storage unit 612 (e.g. Erasable Electronic Programmable Read Only Memory ("EEPROM"), Flash Memory) and a volatile storage unit 616 (e.g. random access memory ("RAM")). Programming instructions 617 that implement functions of the device 600, such as one or more of the methods 100, 300 described herein and/or the compositor 420 described herein, can be maintained, persistently, in non-volatile storage unit 612 and used by processor 608, which makes appropriate utilization of volatile storage 616 during the execution of such programming instructions. Those skilled in the art will now recognize that non-volatile storage unit 612 and volatile storage 616 are examples of computer-readable media that can store programming instructions executable on the processor 608. Furthermore, the non-volatile storage unit 612 and the volatile storage unit 616 are examples of memory.

Non-volatile storage unit 612 can further store data 618, such as one or more of the source images, transformed images, and overlay images/representations discussed herein. Any of the data 618 can be generated on another device and then transmitted to the device 600.

The processor 608 in turn can also be configured to communicate with a display 624, a microphone 22, a speaker 629, and a camera 630.

The camera 630 can include one or more camera devices capable of capturing either still images, videos, or both. The camera 630 can be front or rear facing, or two cameras 630 can be provided, one being front facing and the other being rear facing.

The display 624 comprises any suitable one of or combination of a liquid-crystal display (LCD), organic light-emitting diode (OLED) display, capacitive or resistive touch-screen displays, and the like. In particular, the display 624 can be enabled to display images and video captured by the camera 630.

The microphone 626 comprises any suitable microphone for receiving sound data. The speaker 629 comprises any suitable speaker for providing sound data at the device 600.

It is appreciated that microphone 626, speaker 629, and camera 630 can be used in combination at device 600 to conduct one or more of an audio call and a video call.

In some implementations, input interface 602, display 624, microphone 626, speaker 629, and/or camera 630 are external to device 600, with processor 608 in communication with each of input interface 602, display 624, microphone 626, speaker 629, and/or camera 630 via a suitable connection and/or link.

The processor 608 also connects to a network communication interface 628, also referred to hereafter as interface 628, which can be implemented as one or more radios configured to communicate over a communications link. In general, it will be understood that interface 628 is configured to correspond with the network architecture that is used to implement the particular communications link(s) used. In other implementations a plurality of communications links with different protocols can be employed and thus interface 628 can comprise a plurality of interfaces to support each link.

Those skilled in the art will appreciate that in some embodiments, the functionality of the device 600 can be implemented using preprogrammed hardware or firmware elements, such as application-specific integrated circuits (ASICs) or electrically erasable programmable read-only memories (EEPROMs). In other embodiments, the functionality of device 600 can be achieved using a computing apparatus that has access to a code memory (not shown) which stores computer-readable program code for operation of the computing apparatus. Such computer-readable program code can be stored on a computer readable storage medium which is fixed, tangible and readable directly by these components, such as fixed memory, a removable memory card, a CD-ROM, a fixed disk, a USB drive, and the like. Furthermore, it is appreciated that the computer-readable program can be stored as a computer program product comprising a computer usable medium. Further, a persistent storage device can comprise the computer readable program code. It is yet further appreciated that the computer-readable program code and/or computer usable medium can comprise a non-transitory computer-readable program code and/or non-transitory computer usable medium. Alternatively, the computer-readable program code could be stored remotely but transmittable to these components via a modem or other interface device connected to a network (including, without limitation, the Internet) over a transmission medium. The transmission medium can be either a non-mobile medium (e.g., optical and/or digital and/or analog communications lines) or a mobile medium (e.g., microwave, infrared, free-space optical or other transmission schemes) or a combination thereof.

Figure 7:
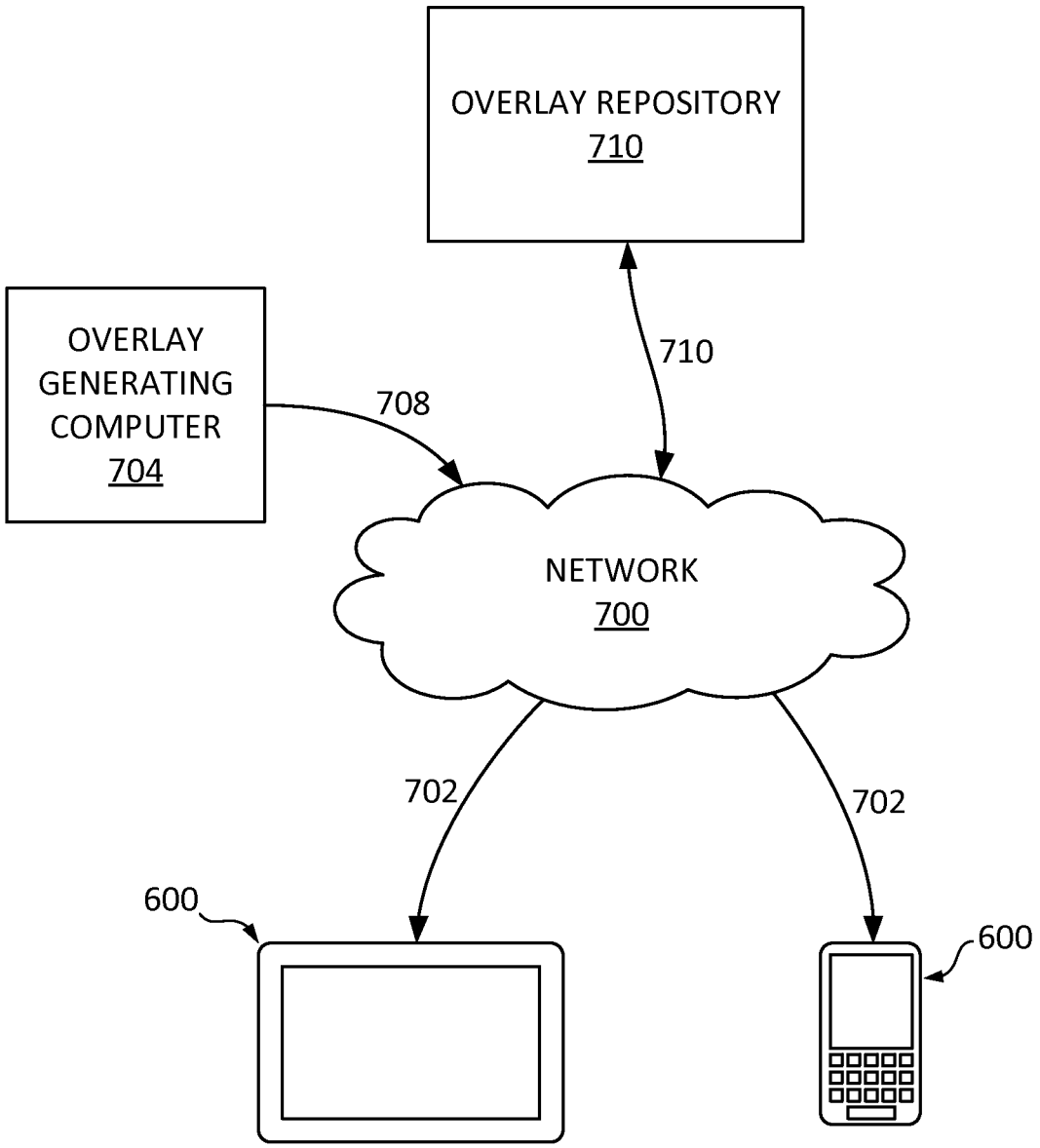
FIG. 7 is network diagram of electronic devices, an overlay generating computer, and an overlay repository.

FIG. 7 shows a network diagram of a network for distributing overlay representations.

A plurality of devices 600 are connected to a communications network 700, such as the Internet, via communications links 702.

An overlay generating computer 704 and overlay repository 706 are also connected to the network 700 by respective communications links 708, 710.

Each communications link 702, 708, 710 comprises any suitable link with the network 700, including any suitable combination of wired and/or wireless links, wired and/or wireless devices, and/or wired and/or wireless networks, including but not limited to any suitable combination of USB cables, serial cables, wireless links, cellular phone links, cellular network links for wireless data (including but not limited to 2G, 2.5G, 3G, 4G+, and the like), Bluetooth links, near-field communication (NFC) links, WiFi links, WiMax links, packet based links, the Internet, network access points, and the like, and/or any combination of such.

The network 700 can comprise any suitable network and/or combination of networks for conveying data among the devices 600, the overlay generating computer 704, and the overlay repository 710. Hence, the network 700 can comprise any suitable combination of wired networks, wireless networks, cellular networks (including but not limited to 2G, 2.5G, 3G, 4G+, and the like), Bluetooth networks, NFC networks, WiFi networks, WiMax networks, packet based networks, the Internet, access points, and the like.

The overlay generating computer 704 is an electronic device that includes a processor, memory, display, and input interface, and is configured to operate on images/video. In this embodiment, the overlay generating computer 704 uses source images to generate transformed images suitable for use as overlays. The overlay generating computer 704 is accordingly capable of efficiently storing and processing source images of a format that natively stores transparency information (e.g., RGBA). The overlay generating computer 704 can be configured to perform the method 100 (FIG. 1) on source images 200 (FIG. 2) to generate transformed images 250 (FIG. 2).

The overlay repository 710 is an electronic device that includes a processor and memory, and is configured to store transformed images for use as overlay representations. The overlay repository 710 may include one or more servers. The overlay representations are stored in a compressed format that does not natively support transparency (e.g., JPEG, H.264). Continuing the example above, transformed images 250 are uploaded to the overlay repository 710 from the computer 704, via the communications links 708, 710, and made available to the electronic devices as overlay representations.

One or more electronic devices 600 can then download one or more overlay representations from the repository 710 via the respective communications link 702. Images or video captured or stored on the device 600 can thus be augmented by the downloaded overlay representations. In this example, one or more overlay representations 250 (FIG. 2) are downloaded from the repository 710 to the device 600, which performs the method 300 (FIG. 3) to obtain a composite image 450 (FIG. 4) for storage or display on the device 600.

One advantage of the above is that a device 600 may not be capable of processing images or video in a format that natively supports transparency information. Thus, overlay representations can be generated on a dedicated computer 704 and then stored in a non-transparency aware format for later downloading and use by the device 600.

Figure 8:
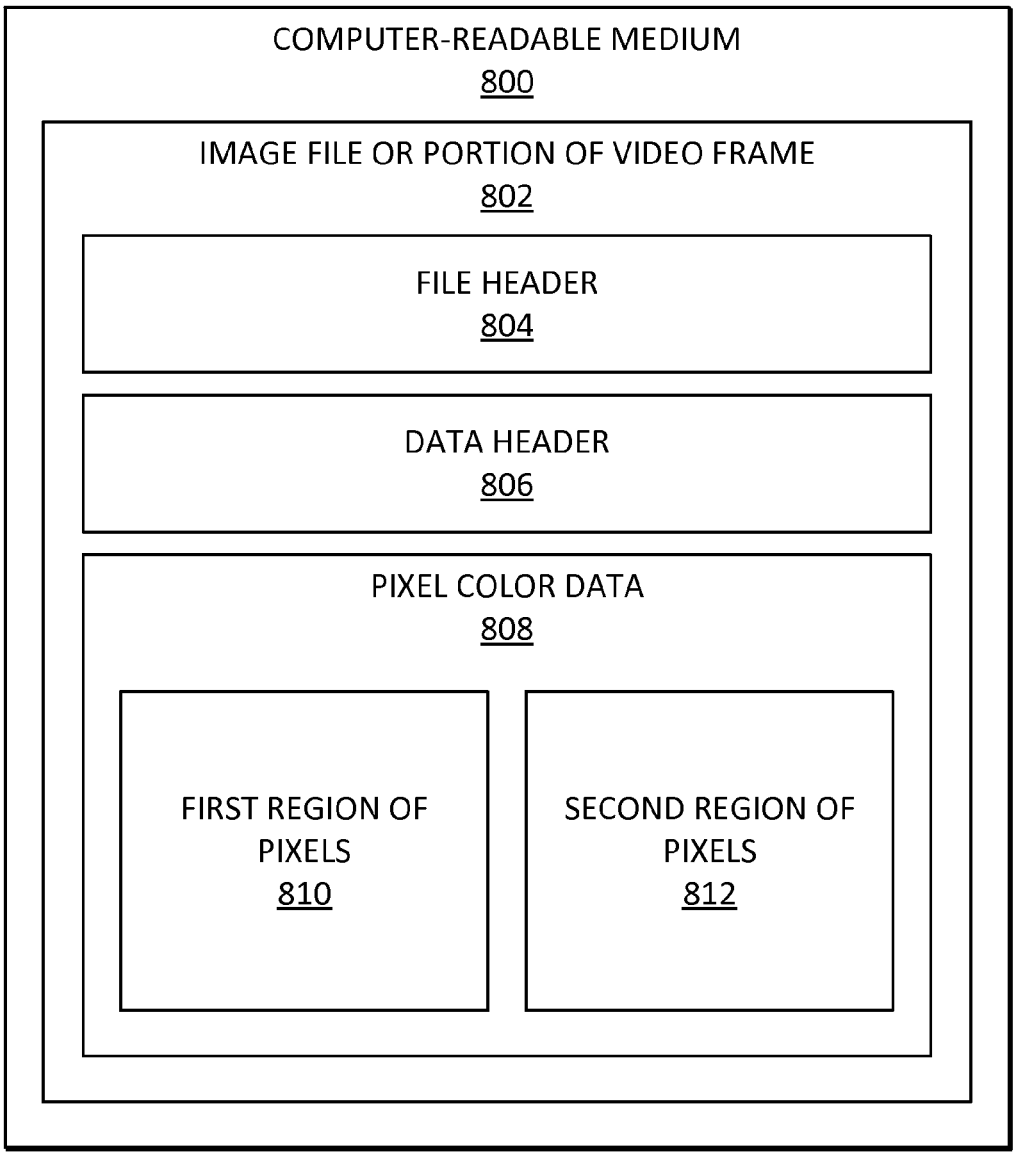
FIG. 8 is a diagram of a computer-readable medium storing an image file or portion of a video frame.

FIG. 8 shows a diagram of a non-transitory computer-readable medium 800. A medium 800 can form a part of any of the device 600 of FIG. 6, the overlay generating computer 704 of FIG. 7, and/or the overlay repository 710 of FIG. 7. Concerning the device 600, the medium 800 may be provided as one or more of the volatile storage unit 616 and the non-volatile storage unit 612.

The computer-readable medium 800 stores a digital representation 802 of a partially transparent image in a format that does not provide native support for transparency. The digital representation 802 can include a file header 804, a data header 806, and pixel color data 808.

The file header 804 can store information such as the file size and other metadata about the file.

The data header 806 can store information such as the image dimensions (width and height), compression scheme, color channel information, and other metadata concerning the image itself.

Any of the filename extension, the file header 804, and the data header 806 can be used to store an indication that the pixel color data 808 stores transparency information.

The pixel color data 808 includes a first region of pixels 810, whose colour information represents the colour information of corresponding pixels of the partially transparent image, and a second region of pixels 812, whose colour information represents the transparency information of corresponding pixels of the partially transparent image. Referring to FIG. 2, for example, the first region of pixels 810 of the representation 802 corresponds to the first region 254 of the transformed image 250 and the second region of pixels 812 of the representation 802 corresponds to the second region 256 of the transformed image 250.

Although a still image is discussed above, the representation 802 can also be used to represent at least a portion of a frame of a video.

In another embodiment, pre-generated overlay representations are loaded onto electronic devices 600 before such devices are provided to end users. In still another embodiment, pre-generated overlay representations are provided by way of a software update to a group of electronic devices 600.

One advantage of the above described techniques is that transparency information can be stored in an image/video format that does not natively support transparency. That is, transparency information can be stored in a format that only allows three bytes per pixel for color information or in a format that lacks an alpha channel. Another advantage is that transparency information can be efficiently used by a wide variety of devices that may not be capable or configured to operate on image/video formats that natively store transparency information.

A portion of the disclosure of this patent document contains material which is subject to copyright protection. The copyright owner has no objection to the facsimile reproduction by any one of the patent document or patent disclosure, as it appears in the Patent and Trademark Office patent file or records, but otherwise reserves all copyrights whatsoever.

Persons skilled in the art will appreciate that there are yet more alternative implementations and modifications possible, and that the above examples are only illustrations of one or more implementations. The scope, therefore, is only to be limited by the claims appended hereto.

What is claimed is:

1. A method of transforming source image data for a source image, the source image data being in a source format providing native support for transparency, the method comprising:

determining, from the source image data, colour information and transparency information for each source pixel of the source image;

generating a transformed image including a first region and a second region by:

for each source pixel of the source image, basing colour information of a corresponding pixel of the first region on the colour information of that source pixel; and basing colour information of a corresponding pixel of the second region on the transparency information of that source pixel, including performing a geometric transformation such that at least one dimension of the second region is less than a corresponding dimension of the first region; and saving the transformed image in a target format not providing native support for transparency.

2. The method of claim 1, wherein the source format is a compressed format, and wherein determining comprises decompressing the source image.

3. The method of claim 1, wherein the source format is a vector-graphic format, and wherein determining comprises:

setting dimensions of the source image; and computing colour information and transparency information for each source pixel of the source image based on the dimensions of the source image.

4. The method of claim 1, wherein the target format is a compressed format, and wherein saving comprises compressing the transformed image.

5. The method of claim 4, wherein compressing comprises applying a transform to colour information for blocks of pixels to obtain frequency-domain information.

6. The method of claim 1, wherein the colour information of each pixel of the first region equals the colour information of the source pixel corresponding to that pixel of the first region.

7. The method of claim 1, wherein the colour information of each pixel of the second region comprises three equal colour components.

8. The method of claim 1, wherein the first region is disjoint from the second region.

9. The method of claim 8, wherein the first region and the second region are adjacent regions.

10. The method of claim 1, wherein the transformed image comprises at least part of a corresponding frame of a transformed video.

11. The method of claim 10, wherein a first frame of the transformed video comprises the first region and a second frame of the transformed video comprises the second region.

12. A method of superimposing a partially transparent overlay image on a base image, an overlay representation of the overlay image being in a format not providing native support for transparency, the overlay representation including a first region of pixels—whose colour information represents colour information of corresponding pixels of the overlay image—and a second region of pixels —whose colour information represents transparency information of corresponding pixels of the overlay image, the method comprising:

for each base pixel in the base image:

determining first colour information from the colour information of that base pixel;

determining second colour information from the colour information of at least one corresponding pixel of the first region of the overlay representation;

determining transparency information from the colour information of at least one corresponding pixel of the second region of the overlay representation, including performing a geometric transformation on the second region of the overlay image, wherein at least one dimension of the second region is less than a corresponding dimension of the first region; and computing colour information for a corresponding pixel of a composited image by combining the first colour information, the second colour information, and the transparency information; and saving the composited image in a format not providing native support for transparency.

13. The method of claim 12, wherein computing colour information comprises computing a weighted average of the first colour information and the second colour information, the weighting being determined by the transparency information.

14. The method of claim 12, further comprising determining the locations of the first region and of the second region within the overlay representation.

15. The method of claim 12, wherein at least one of the base image and the overlay representation is in a compressed format, and wherein the method further comprises decompressing the at least one of the base image and the overlay representation.

16. The method of claim 15, wherein compressing comprises applying a transform to colour information for blocks of pixels to obtain frequency-domain information.

17. The method of claim 12, wherein the format of the composited image is a compressed format, and wherein saving comprises compressing the composited image.

18. The method of claim 12, wherein determining the transparency information comprises using a predetermined colour component of the colour information of the corresponding pixel of the second region of the overlay representation.

19. The method of claim 12, wherein determining the transparency information comprises averaging colour components of the colour information of the corresponding pixel of the second region of the overlay representation.

20. The method of claim 12, wherein at least one dimension of the overlay image is different than the corresponding dimension of the base image, and wherein determining the second colour information and determining the transparency information each comprise a scaling operation based on the dimensions of the overlay image and of the base image.

21. The method of claim 12, wherein the base image comprises at least part of a frame of a base video, and wherein the composited image comprises at least part of a corresponding frame of a composited video.

22. The method of claim 12, wherein the overlay representation comprises at least part of a frame of an overlay representation video.

23. The method of claim 12, wherein the geometric transformation comprises a scaling operation.

24. An electronic device comprising:

memory; and a processor coupled to the memory, the processor configured to:

determine, from source image data, colour information and transparency information for each source pixel of a source image, the source image data being in a source format providing native support for transparency;

generate a transformed image including a first region and a second region by:

for each source pixel of the source image, basing colour information of a corresponding pixel of the first region on the colour information of that source pixel; and basing colour information of a corresponding pixel of the second region on the transparency information of that source pixel, including performing a geometric transformation such that at least one dimension of the second region to be less than a corresponding dimension of the first region; and save the transformed image in a target format not providing native support for transparency.

25. An electronic device comprising:

memory; and a processor coupled to the memory, the processor configured to:

superimpose a partially transparent overlay image on a base image, an overlay representation of the overlay image being in a format not providing native support for transparency, the overlay representation including a first region of pixels—whose colour information represents colour information of corresponding pixels of the overlay image—and a second region of pixels—whose colour information represents transparency information of corresponding pixels of the overlay image, by, for each base pixel in the base image:

determining first colour information from the colour information of that base pixel;

determining second colour information from the colour information of at least one corresponding pixel of the first region of the overlay representation;

determining transparency information from the colour information of at least one corresponding pixel of the second region of the overlay representation, including performing a geometric transformation on the second region of the overlay image, wherein at least one dimension of the second region is less than a corresponding dimension of the first region; and computing colour information for a corresponding pixel of a composited image by combining the first colour information, the second colour information, and the transparency information; and save the composited image in a format not providing native support for transparency.

26. A non-transitory computer-readable medium storing processor-executable instructions that when executed cause a processor to:

determine, from source image data, colour information and transparency information for each source pixel of a source image, the source image data being in a source format providing native support for transparency;

generate a transformed image including a first region and a second region by:

for each source pixel of the source image, basing colour information of a corresponding pixel of the first region on the colour information of that source pixel; and basing colour information of a corresponding pixel of the second region on the transparency information of that source pixel, including performing a geometric transformation such that at least one dimension of the second region is less than a corresponding dimension of the first region; and save the transformed image in a target format not providing native support for transparency.

27. A non-transitory computer-readable medium storing processor-executable instructions that when executed cause a processor to:

superimpose a partially transparent overlay image on a base image, an overlay representation of the overlay image being in a format not providing native support for transparency, the overlay representation including a first region of pixels—whose colour information represents colour information of corresponding pixels of the overlay image—and a second region of pixels—whose colour information represents transparency information of corresponding pixels of the overlay image, by, for each base pixel in the base image:

determining first colour information from the colour information of that base pixel;

determining second colour information from the colour information of at least one corresponding pixel of the first region of the overlay representation;

determining transparency information from the colour information of at least one corresponding pixel of the second region of the overlay representation, including performing a geometric transformation on the second region of the overlay image, wherein at least one dimension of the second region is less than a corresponding dimension of the first region; and computing colour information for a corresponding pixel of a composited image by combining the first colour information, the second colour information, and the transparency information; and save the composited image in a format not providing native support for transparency.

* * * * *